US006049045A

United States Patent [19]

Becker et al.

[11] Patent Number: 6,049,045

[45] Date of Patent: Apr. 11, 2000

[54] PERSONAL COMPUTER POWER LOCKING MECHANISM

[76] Inventors: Mark H. Becker, 1235 Eucalyptus Ave., Vista, Calif. 92084; Stephen T. Brightbill, 2323 Barley Dr., Vista, Calif. 92128

[21] Appl. No.: 09/173,865

[22] Filed: Oct. 16, 1998

[51] Int. Cl.[7] ..... H01R 13/70

[52] U.S. Cl. ..... 200/51 R; 200/43.08

[58] Field of Search ..... 200/51 R, 43.08, 200/42.01, 42.02; 439/354, 304

[56] References Cited

U.S. PATENT DOCUMENTS

| | | | |
|---|---|---|---|
| 2,789,171 | 4/1957 | Kuta | 200/51 |
| 3,345,603 | 10/1967 | Cohen | 339/176 |
| 4,313,488 | 2/1982 | Harmison, Jr. . | |
| 4,890,006 | 12/1989 | Huang . | |
| 5,120,236 | 6/1992 | Gilbert . | |
| 5,190,466 | 3/1993 | McVey | 439/304 |
| 5,231,310 | 7/1993 | Oh . | |
| 5,338,212 | 8/1994 | Kerrigan . | |
| 5,434,558 | 7/1995 | Zeder | 340/568 |
| 5,734,206 | 3/1998 | Keizer et al. | 307/116 |
| 5,853,298 | 12/1998 | Pacher | 439/352 |

*Primary Examiner*—Michael L. Gellner
*Assistant Examiner*—Nhung Nguyen
*Attorney, Agent, or Firm*—Curtis L. Harrington

[57] ABSTRACT

A power locking mechanism provides a structure for supporting a physically manipulable lock, and is in communication with a permanently installed switching connector fitting within the confines of an alternating current power socket typically found at the rear of a personal computer. The switching connector has a male portion which becomes a male locking portion with the addition of a locking clip member which positively engages the alternating current socket of a computer, an intermediate portion containing circuitry to insure proper switched on and off operation, and a female socket portion for interfitting with the end of the power cord which was previously used to connect into the alternating power socket. As such, installation of the device of the invention involves removing the power cord computer plug from the computer's power input socket, inserting the male portion of the switching connector into the socket and inserting the power cord plug into the female portion of the switching connector of the invention. Locking is achieved with a flared engagement member which fits into an indentation on the male portion of the switching connector. The clip member of one embodiment is removable in order that the switching connector be tested in place, before insertion to commit to permanent connect status.

16 Claims, 6 Drawing Sheets

PERSONAL COMPUTER POWER LOCKING MECHANISM

FIELD OF THE INVENTION

The present invention relates to the field of personal computer devices and more particularly to security devices which can give any user of a personal computer an extremely simple access security device to help prevent unauthorized access to the user's computer, an unauthorized user being forced to at least disassemble the computer's housing or destroy a portion of the computer's housing or power input, or the security device, or all three, in order to provide jumper provided power to a locked computer.

BACKGROUND OF THE INVENTION

Appliance locking devices have been known for some time and typically rely upon the provision of a low grade level of bother in an attempt to inhibit unauthorized use. The least secure of these devices involve a lock-box interposed in an extension cord, and requires special installation. This scheme is disclosed in U.S. Pat. No. 5,120,236 to Gilbert and in U.S. Pat. No. 5,231,310 to Oh. The problem with these types of systems is that a pair of wire cutters and electrical tape can circumvent the security they provide. The time to accomplish this is on the order of about one minute. Further, nothing needs to be disturbed beyond the power cord in order to circumvent the system. The computer, monitor and peripherals do not need to be disturbed.

In this configuration, the security had is minimal. The only value of such an easily circumventable system is that the user may know that his system has been circumvented, but only where the lines on either side of the lock box are cut. In some cases the lock box and power cord combination can simply be replaced with a regular power cord, in which case the user would never know his system had been accessed. Even where the appliance uses an unusually-shaped plug, such plugs are typically standard and an extension cord can readily be constructed.

Other methods can be employed including expensive code systems and passwords and internally programmed schemes. These schemes often require additional hardware, and even where additional hardware is not required, a complex password scheme can require additional time for each system startup. A password scheme can be circumvented or "hacked", usually with the computer owner never knowing that the system has been accessed. An internal system requires additional costly software and maintenance as would any other program. Corruption of the program might render the system inaccessible. In addition, the system can be booted up with other software and where the security system is not to some extent integrated with the bios it can be easily circumvented. Regardless of the form, password type security is expensive, time consuming to install, and occupies system resources.

Systems which are networked may not be completely protectable even where a password is required to start up the monitor location. In other networked systems, your password or identity is supplied automatically when your unit powers on and starts up. As such, protecting a single unit in a network system, using additional software or hardware might not be permissible or feasible without having to make extensive adjustments to the overall networked system.

Typical stand alone or personal computers need security systems for a variety of reasons. Some users have sensitive information and need to insure that their computer cannot be turned on for any reason. Parents have a need to restrict access to the family computer due to the unwanted availability of internet access and material unsuitable for children. In office situations, and even for employees, the ethics of employees privacy are not honored by unethical employers, and conversely the secrets and confidences of employers need protection from unethical employees.

Computer users need a simple method of providing security for their computer which will not require additional software, replacement of existing connectors, replacement of existing power cords, special adaptation of power into the computer housing, nor hardware nor special adaptation of hardware. The needed security system should be able to be installed in less than one minute, give an indication of whether the system is unlocked and accessible by anyone or locked and accessible by no one. The security system should not be circumventable without significant and highly visible disruption of the protected computer system.

SUMMARY OF THE INVENTION

The personal computer power locking mechanism of the present invention provides a structure for supporting a physically manipulable lock, and which is in communication with a permanently installed switching connector fitting within the confines of an alternating current power socket, typically a female power socket or receptacle and typically found at the rear of most personal computers. The switching connector used in the invention has a male portion which becomes a male locking portion with the addition of a locking clip member which positively engages the alternating current socket of a computer, an intermediate portion containing circuitry to insure proper operation, and a female socket portion for interfitting with the end of the power cord which was previously used to connect into the alternating current power socket at the rear of the personal computer. The clip member can be provided as a separate, removable clip, or as an integrated structure formed integrally with the switching connector body. As such, installation of the device of the invention involves removing the power cord computer plug from the computer's power input socket, inserting the male portion of the switching connector into the socket and inserting the power cord plug into the female portion of the switching connector of the invention. Locking is achieved with a flared engagement member which depends from a clip member. The clip member, if supplied as a separate structure, fits into an indentation on the male portion of the switching connector. If the clip member is integrally formed with the switching connector, the only portion which may be visible is one or two flared engagement members. The clip is removable in order that the switching connector be tested in place, before the user has to commit the switching connector to permanent connect status.

A cord extends from the intermediate portion of the switching connector of the invention and may leads to an access support structure which may be otherwise attached to any surface on or near the computer housing, or left lying on a table or stored behind the computer. As such, the housing can be either displayed prominently to show that the system is protected, or it may be hidden where a hacker or snoop would go through a lot of trouble discovering why the computer could not be turned on. The male portion of the switching connector of the invention has metal prongs which are angled to positively engage the interior walls of the enclosed alternating current power socket used on the majority of computers. Attempting to remove the male portion of the switching connector from the power input socket is virtually impossible. Tests performed indicate that forces of up to 150 pounds will not cause the switching connector to become dislodged from the alternating current power socket of the computer so long as it remains in tact and properly attached and supported by the computer housing. In most cases, if such high force is applied, the alternating current power socket will likely break, before the switching connector of the invention will be dislodged. Extreme pulling forces will result in delamination and destruction of the cord before disconnection can occur. As a result, the only other semi-reasonable way to circumvent the lockout of the present invention would be typically to remove the monitor from atop the computer housing, and disassemble the computer housing to provide access to the inside surfaces and connectors associated with the alternating current power socket. Once accessed, wires could be spliced, or if possible the alternating current power socket could be replaced, and if it is not possible to replace the socket, an alternate socket or wiring to a parallel socket could be set up. In this manner, if the key is ever lost, and the computer needs short term bypass of the locking device, only about 20–30 minutes of inconvenience will result. However, since the inconvenience will be far from inconspicuous, the device of the present invention serves its purpose to inhibit non-detectable tampering.

In only the simplest embodiment, where the current is carried in the a lead wire to the access support structure, this current carrying lead wire could be cut and spliced together, but such splicing can be further prevented by the use of shielded cable.

In addition, since the invention secures and controls external power, it also enables further protection since it shifts the security focus to the housing. Since bypass of the power lock out must normally occur by opening the housing, further protection can be obtained by more secure housing protection. Housing protection can be increased by providing odd-sized or rare fasteners and fastener tools, or in extreme cases by providing a table or other structure lock down, such as a frame lock, bars, or a secure box. Further, where extreme lock down and isolation structures are used, a permanent locking clip member may not be necessary, especially where the switching connector cannot be manually accessed. Making the housing much harder to access further intensifies the secure status of the computer, its access, memory storage, passwords and operating systems.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figures 1, 2:
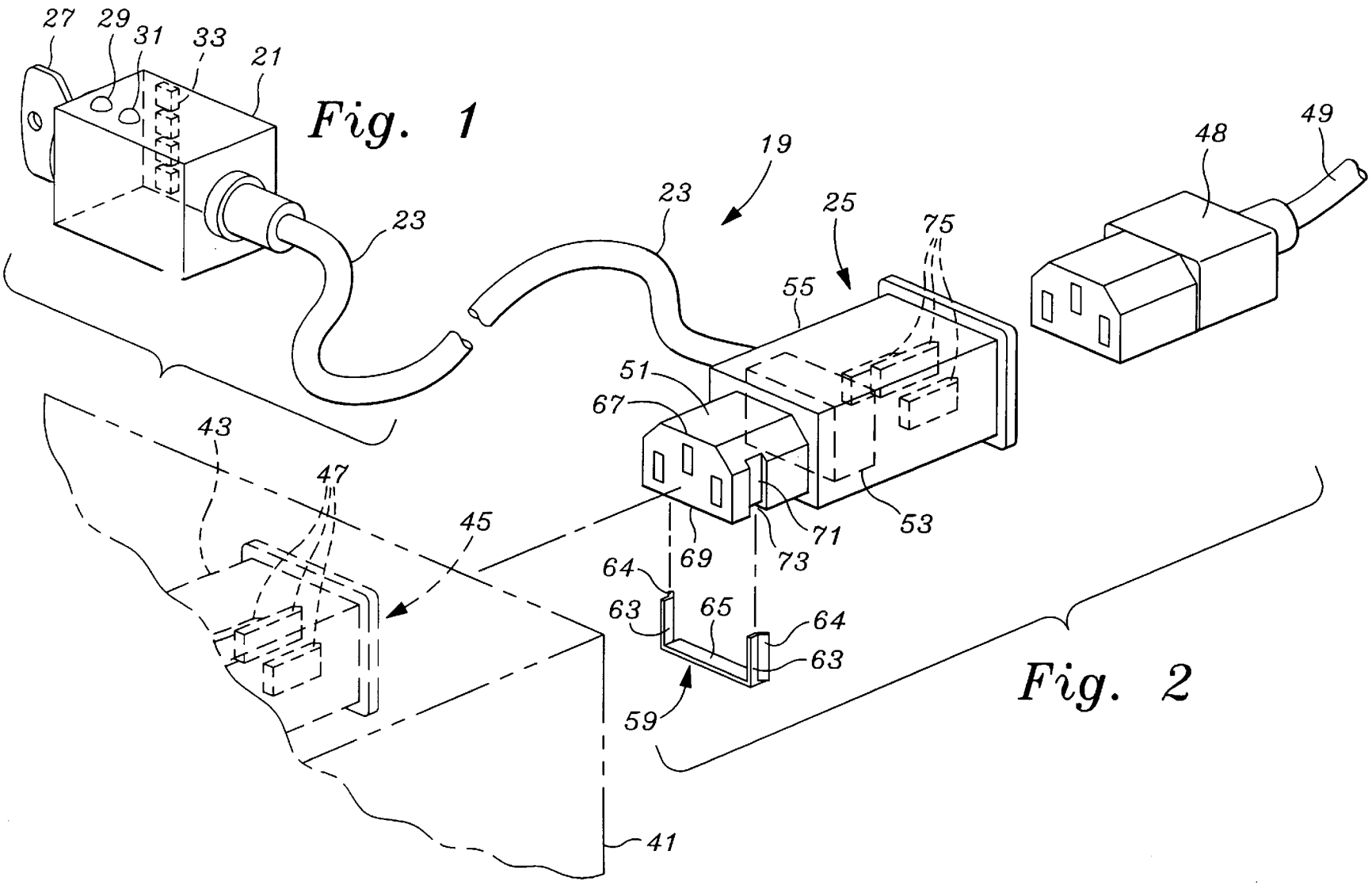
FIG. 1 is perspective view looking backwards in the direction of the back of a computer housing and illustrating the computer locking system of the invention including a key lock structure with light and key pad.
FIG. 2 is a perspective exploded view looking backwards toward the back of a computer housing and illustrating the computer locking system, switching connector in position to be inserted into a female housing socket, and power control cord in a position to be inserted into a female connector portion of the switching connector.

The description and operation of the invention will be initiated with reference to FIGS. 1 & 2. FIGS. 1 & 2 are exploded perspective overall views illustrating a power locking mechanism 19. FIG. 1 illustrates an access support structure 21 which may be of any size or shape, and which is attached to an electromagnetically operable cable 23. FIG. 2 illustrates a broken continuity of cable 23 as connected to a switching connector 25. The cable 23 can be twisted pair, coaxial, ribbon cable, power conductor, fiber optic or any variation on these. The purpose of cable 23 is to communicate an "on/operate" or "off/disable" command from the access support structure 21 to the switching connector 25. Cable 23, in addition to a wide variety of possibilities for transmission mode, can also have a shielded outside such as an armor to further and be more resistive to tampering.

The purpose of having an access support structure 21 which is remotely located from the switching connector 25 is purely for convenience of the user and for heightened visibility. Referring to FIGS. 1 & 2, the presence and turn angle of a key 27 (connected to a key switch within the access support structure 21) and or illumination or non-illumination of a light 29, light 31, will provide a ready indication that the power locking mechanism 19 is enabling access to systems associated with it, or that access is denied. Ideally, key 27 should be removable regardless of whether the power locking mechanism 19 is in the locked or unlocked condition. An optional keypad 33 can be used to heighten security by adding a requirement of a combination lock to work in conjunction with the key lock, or a combination may be utilized by itself to operate the power locking mechanism 19. Other security devices such as key cards, key card swipers, or other electromagnetic or optical access structures can be used in place of a key 27.

It is understood that all of the structures of the access support structure 21 may be integrated into a common support or housing associated with the switched connector 25 to give advantages in modularity, but a user would otherwise have to physically reach toward and access typically the rear of the computer. In addition, the heightened deterrence profile of the status of the equipment controlled by the power locking mechanism 19 would be lost where the existence of a locking mechanism was not prominent.

From a user's viewpoint light 29, and the optional second light 31 is easily seen. Lights 29 and 31 are each typically a light emitting diode, or LED indicator and may be used to indicate a power-enabled condition for the power locking mechanism 19. Where only one light 29 or 31 is used, it may preferably be green to give an indication when illuminated that the system is power-enabled. Where two lights 29 and 31 are used, a red light emitting diode could be used to indicate that the power locking mechanism is locked as one of the lights 29, while the other of the lights 31 could be green to indicate that the power locking mechanism 19 is power-enabled. In any specific wiring realization where power was supplied through the access support structure 21, a small ground wire may be extended in order to operate one of the lights 29 or 31 during the power off condition.

The key 27 is prominently mounted with respect to general viewing, and the optional key pad 33 is located to one side since it may require somewhat more surface area of the access support structure 21. It must be understood that the mounting of the access support structure 21 is done to heighten the recognition that a power locking system 19 is present, and that the access support structure 21 need not be attached permanently.

A general housing 41 is shown which is typically a rear vertical panel on a personal computer, but which may be any structure capable of supporting a female socket 43. The female housing socket 43 most often encountered with computer equipment, printers, fax machines and the like is a hard plastic or plastic and metal structure which is riveted or otherwise very securely attached to housing 41. In most cases the attachment is permanent with the use of welding, rivets, or with fasteners which are not easily removed.

The female housing socket 43 has an internal space 45 having a series of three metal conductors 47 extending the length of the internal space 45 and seen in the opening to the internal space 45. Also seen displaced from the female housing socket 43 is a male plug 48 attached to a power cord 49. Plug 47 is male because it fits within the confines of the internal space 45, and even though its contact structures are located within contact receiving apertures. Normally, male plug 48 fits within female housing socket 43 to supply alternating current power to any equipment located within the general housing 41. Once the male plug 48 is removed from the female housing socket 43, the switching connector 25 of the power locking mechanism 19 can be interposed therebetween to complete and control the path of electrical power.

The switching connector 25 includes a male connector 51 followed by a switching member 53 which is followed by a female connector 55. The male connector 51, switching member 53 and female connector 55 are preferably mechanically connected to each other such that switching connector 25 is available as a continuous housing. Especially where the switching connector 25 is made as a single integrated unit, and as shown in FIG. 2 male connector 51 becomes male connector portion 51 followed by a switching member 53 which becomes switching member portion 53, which is followed by a female connector 55 which becomes female connector portion 55. Switching member portion 53 at its simplest is simply a space where electrical power can be tapped off and through the access support structure 21 and re-introduced to make power available to the male connector portion 51. In more sophisticated embodiments, switching member portion 53 is used to house switching transducers and the like, especially where the power flow is to be isolated to the switching connector 25 boundaries.

The male connector portion 51 has part of its material removed or lacking to accommodate a clip member 59 shown in exploded relationship below the switching connector 25. Removability of the clip member 59 enables two potentially important purposes. First, where the area around the female housing socket 43 is physically restricted as with a lock box enveloping the computer housing where users can't physically reach the switching connector 25, substantially irreversible locking of the switching connector 25 within the female housing socket 43 is not necessary. In this case, removal of the clip member 59 enables the power locking mechanism 19 to be available for future use in other pieces of equipment. Second, the removability of the clip member 59 enables the switching connector 25 to have its male connector portion 51 inserted in the female housing socket 43 to test the power locking mechanism 19, to make sure that it is in good working order and is completely satisfactory to the user both in working order and in meeting customer expectations, before it is substantially irretrievably attached to the female housing socket 43.

The clip member 59 is typically a "U" shaped member where opposing sides of the "U" shape each carry a flared engagement spring member 61. Engagement spring member 61 will preferably have a sharp end termination for positively and essentially irretrievable engagement of an inside surface of the female housing socket 43. The bottom of the "U" shape is a connecting web to stabilize the sides. The clip member 59 is preferably made from spring steel and will thus have the ability to bend, but only with a high force component of reaction. When the clip member 59 is engaged with the switching connector 25, and as the male connector portion 51 is inserted in the female housing socket 43, the flared engagement tabs or members 61 will bend inward as urged by the female housing socket 43, but the flared engagement spring members 61 in reaction to such inward folding, will exert significantly high pressure against the internal side walls of the internal space 45 of the female housing socket 43.

Especially where the inner walls of the internal space 45 of the female housing socket 43 are plastic, the flared engagement spring members 61 may even score the inside of the female housing socket 43 on the way in, and at the extent of termination, when the switching connector 25 is fully inserted into the female housing socket 43, the engagement spring members 61 are expected to dig into the walls of the female housing socket 43. By digging in, the engagement spring members 61 form dimples, furrows, or indentations which prevent the switching connector 25 from being removed from the female housing socket 43. Clip member 59 also has side walls 63, each having a flared engagement portion 64. Clip member 59 also has a connecting web 65 which connects the side walls 63. Ideally, the clip member 59 is formed from a single piece of material and may be bent into a "U" shape along with an operation which punches the engagement spring members 61 as a "U" shaped cut leaving one end of the engagement spring member 61 continuous with its associated side wall 63. As can also be seen, the male portion 51 as a plug structure contains a hemi-octagonal side 67 and a rectangular side 69. Also seen is a side slot 71 and a portion of a bottom slot 73 which are accommodation spaces which are formed in the sides and bottom or rectangular side 69 of the male connector portion 51 to accommodate the clip member 59. The slots 71 and 73 may be continuous or intermittent and need only occur to the extent necessary to accommodate clip member 59, or any other structure for locking switching connector 25 or its portions within female housing socket 43. The clip member 59 is made of sufficiently thin metal that the cross sectional area of material left is more than enough for good structural support and results in no weakening of the male portion 51 on either side of the slots 71 and 73. Also seen are a set of three conductors 75 within the female connector portion 55.

Figure 3:
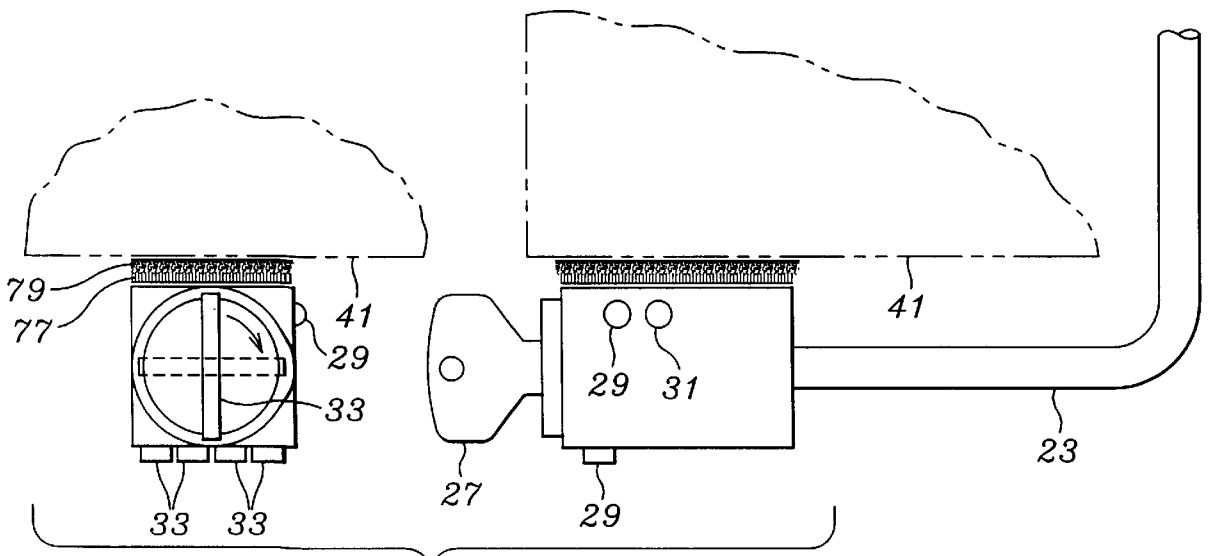
FIG. 3 is a downward view and frontal view of the key lock structure of FIG. 1 shown adjacent to and optionally attachable to a computer housing or other structure.

Referring to FIG. 3, a front and top view of a typical installation from a user's viewpoint illustrates the access support structure 21 as a stylish housing supporting the lights 29 & 31, key 27 and optional keypad 31, and attached to a surface 33 which may be a surface of a computer housing or a monitor housing, or even a desk top or any other structure. It is shown being attached with an expanse 77 of one of hook members and loop members being attached to the access support structure 21, and an expanse 79 of the other one of the surface of hook members and loop members being attached to the surface 33. However, where hook and loop expanses 77 and 79 are used, or where no method of attachment is used at all, the access support structure 21 can be detached and simply brought to rest behind the computer equipment.

Figure 4:
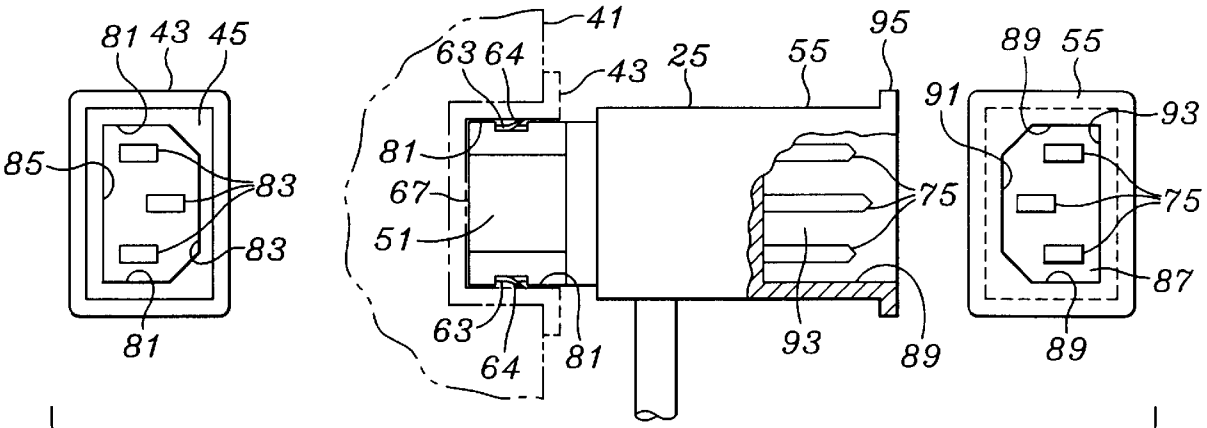
FIG. 4 is a downward and partially broken away view of the switching connector installed into a female housing socket and including end views of the female housing socket and the female connector portion of the switching connector.

Referring to FIG. 4, a partially broken away top plan view of the female housing socket 43 shown with the male portion 51 of the switching connector 25 inserted, as well as a face view of the female housing socket 43 before insertion of the switching connector 25 and a face view of the female connector portion 55 of the switching connector 25, without the male power cord plug 47 is seen. FIG. 4 illustrates that the female housing socket 43 internal space 45 has a pair of side walls 81, and a hemi-octagonal wail 83 and a rectangular or flat wall 85. Side walls 81 will be engaged by flared engagement portions 64.

In order to interfit with the plug 47, the female connector portion 55 will also have an internal space 87, a pair of side walls 89, and a hemi-octagonal wall 91 and a rectangular or flat wall 93. The female connector portion 55 may also have a flanged structure 95 to facilitate further protection or further mounting of the switching connector 25.

Figure 5:
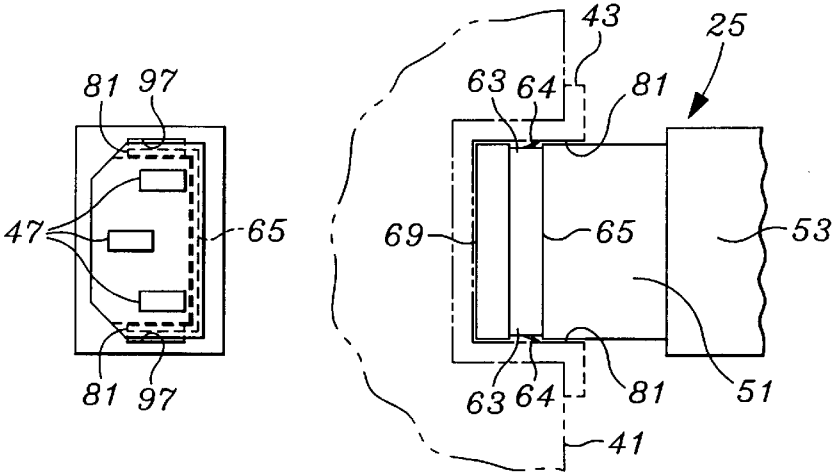
FIG. 5 is a top and end view of the details of interfitting engagement of the engagement clip member into a female connector and with respect to the male portion of the switching connector.

Referring to FIG. 5, a bottom view of the female housing socket 43 is shown with the male portion 51 of the switching connector 25 inserted, as well as a face view of the female housing socket 43 after insertion of the switching connector 25 is seen. FIG. 5 illustrates the engagement of the flared engagement portion 64 against the side walls 81 resulting in the flared engagement portion 64 digging a small trench 97 into each of the side walls 81, especially if it is attempted to manually remove the switching connector 25 from the female housing socket 43.

The Figure bottom view of the switching connector 25 illustrates the connecting web 65, and the flared engagement portions 64 can be seen engaging the side walls 81 of the female housing socket 43 as they extend beyond the outer reaches of the connecting web 65. The connecting web 65 is preferably situated to lie across the rectangular side 85 of the female housing socket 43 and against the rectangular side 69 of the male connector portion 51, in order to increase the linear force distribution along the edges of the connecting web 65 and the side walls 63 of the clip member 59. The linear edge portion of the clip member 59 which engages the sides of the side slot 71 and bottom slot 73 of the male connector portion 51 includes the edge of the side walls 63 and connecting web 65. When the clip member 59 is engaged such that the connecting web 65 is on the rectangular side of the female housing socket 43, the extent of the groove 58 of the male connector portion 51 engaged will be maximized. The clip member 59 is both easy to manufacture and easy to install within the side slot 71 and bottom slot 73.

Figure 6:
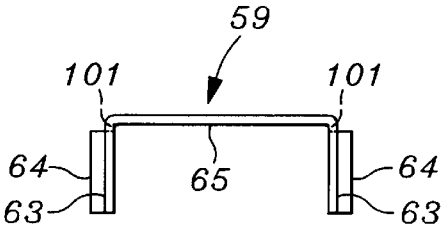
FIG. 6 is a front view of the clip member seen in FIGS. 2 and 5.

Referring to FIG. 6, a forward plan view of the clip member 69 which would normally face toward the switching member portion 53 when installed on the male connector portion 51 is seen with its leading edge of both the side walls 63 and connecting web 65 facing the observer. Also seen is flared engagement portions 64, and a dashed line 99 which represents a hidden angular turn giving the flared engagement portions 64 a sharper edge and sharper profile. Also seen in dashed line format are tiny bend relief portions 101 which represent removed material creating a small gap between the closest extent of the flared engagement portions 64 and the outer edges of the connecting web 65.

Figure 7:
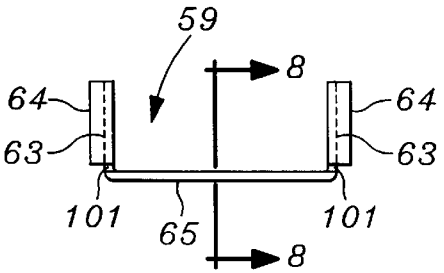
FIG. 7 is a rear view of the clip member of FIGS. 2, 5, & 6.

Referring to FIG. 7, a rearward plan view of the clip member 69 which would normally face toward the switching member portion 53 when installed on the male connector portion 51 is seen with its leading edge of both the side walls 63 and connecting web 65 facing the observer. Also seen are flared engagement portions 64, and directly seen are angular turns 99 which give the flared engagement portions 64 a sharper edge profile. Also seen in dashed line format are the side walls 63 the outer edges of which cannot be seen along the majority of the height of clip member 59 due to their being hidden by the flared engagement portions 64. Directly seen are the bend relief portions 101 as removed material creating a small gap between the closest extent of the flared engagement portions 64 and the outer edges of the connecting web 65.

Figure 8:
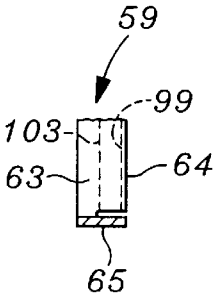
FIG. 8 is a side sectional view of the clip member taken along line 8—8 of FIG. 7.

Referring to FIG. 8, a side sectional view taken along line 8—8 of FIG. 7 shows the connecting web 65 in section, side wall 63, and a dashed line 103 which represents the vertical fold between the flared engagement portion 64 and the side wall 63. Because the view of the side wall 63 is from the inside, the angular turns 99 are on the other, non viewed, side of the side wall 63.

Figure 9:
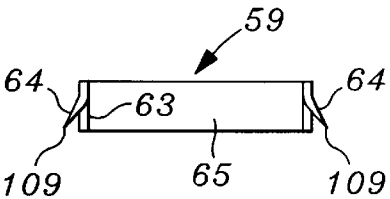
FIG. 9 is a top view of the clip member of FIGS. 6–8.

Referring to FIG. 9, a top view of the clip member 59 illustrates sharp edge 109 of the flared engagement portions 64, and this view illustrates the opposing holding and engagement power of the engagement portions 64.

Figure 10:
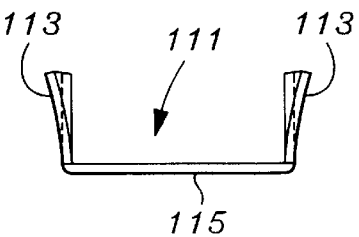
FIG. 10 is a variation of the clip member from a perspective similar to FIG. 7, where the engagement members are twisted to form a more concentrated gauging engagement with the internal surface of a female connector.

Referring to FIG. 10, a variation on the clip member 59 in FIGS. 6–8 is shown as a clip member 111 which lacks the bend relief portions 101, and rather than having a flared engagement portion having a flat outside edge as was seen with respect to flared engagement portion 64, the clip member 111 has a twisted side wall 113. The twisted side wall has its greatest twist displacement at the end farthest from a connecting web 115. Rather than a separately discernable side wall and engagement portion, the engagement is had between the section of side wall 113 having the greatest twist displacement 113 and the side walls 81 of the female housing socket 43. The profile of the twisted side wall 13 is expected to dig more deeply into the housing socket 43. Other twist patterns are possible, including a twist which maximizes along the middle of the side wall 113.

Other variations are possible. A portion of the connecting web, either 65 or 115 can be flared away from the remainder of the connecting web 65 or 115, especially downwardly from the perspective of FIGS. 7 and 9, to create engagement with the flat wall 85 of the female housing socket 43.

As has been previously discussed, the number of possible different electrical transmission, control and switching schemes which can be employed with respect to the switching connector 25 are numerous. The simplest switching scheme is believed to be illustrated in FIG. 10. The switching scheme of FIG. 11 brings power from one of the two power conductors away from the switching connector 25 and to the access support structure 21. The key 27 or keypad 33 operates a switch 121 having a first terminal 123 connected to one of the two power conductors 75, the third, middle conductor typically being a grounding conductor. The switch 121 has a terminal 125 connected to one of the two power socket connectors 127 (only one power socket connector 127 is seen) within the male connector portion 51 which both corresponds with the conductor 75 connected to terminal 123 and which engages with a conductor 47 of the female housing socket 43. As such, the switch 121 within the access support structure 21 receives a flow of power, and must use a relatively heavy duty or other properly rated switch to effectively and safely control the power passing into the access support structure. In cases where the light 29, for example, is to illuminate red to show a locked system, a very small wire from the other one of the power conductors 75 would be necessary to be extended to the access support structure 21, in order to power a light 29 when power is otherwise being shut out from the computer equipment. A light 31 which is to illuminate when the system is on can be powered with the power passing through the access support structure 21 and across the switch 121 either by induction or other method.

Figure 12:
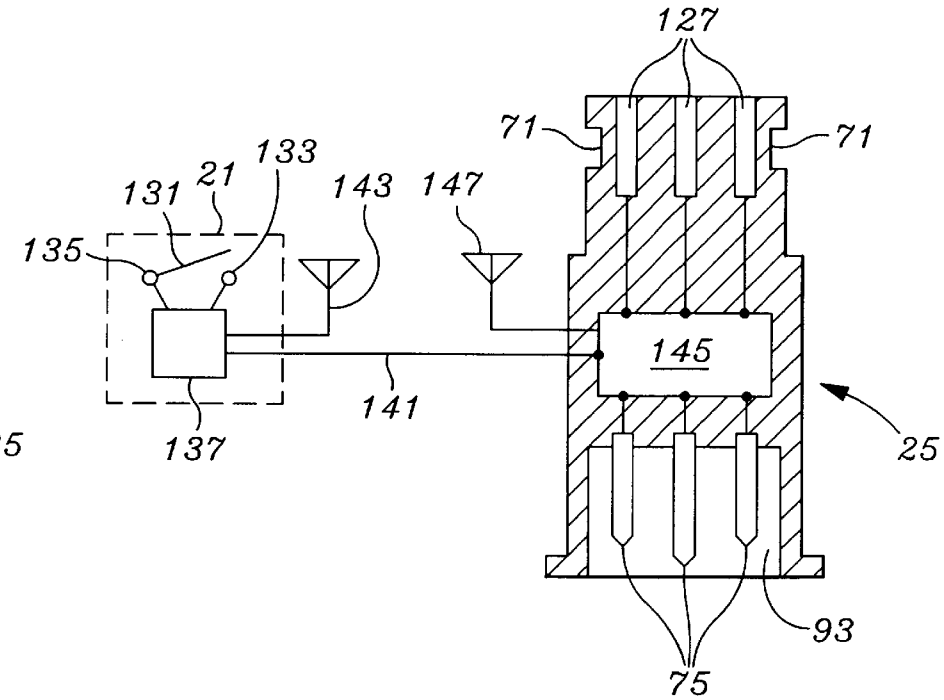
FIG. 12 is an overall simplified schematic illustrating a switch within an access support structures, a transducer connected to the switch, a link extending from the access support structure to the switching connector and connected to a switching transducer which is connected between the conductors of the male portion of the switching connector and a conductor of the female connector portion of the switching connector.

Referring to FIG. 12, a generalized view of a system using other than a diversion of power to the access support structure 21 is seen. Within the access support structure 21 a switch 131 has terminals 133 and 135 which is connected to a transducer 137. The transducer 137 can be any structure necessary to detect whether the terminals 133 and 135 are closed. In addition, a switch 131 is not totally necessary. The transducer 137 can operate without a switch as represented in the boundaries of access support structure 21. The transducer 137 can be, for example, a card reader, a direct reader of the position of key 27, a key pad combination reader, a fingerprint identity transducer, retina scanner, or any transducer which accepts an input and is capable of transmitting to another location an indication commanding a system to be power enabled or power locked out.

A line 141 or electromagnetic structure 143 may be provided to transmit such a power enabled or power locked out signal to switching connector 25. Line 141 can be conductors, fiber optic, coaxial, or other. The electromagnetic structure 143 can be optical or radio frequency or other electromagnetic transmitter.

The switching connector 25 has a power switch and receiving transducer 145 which is connected to one or both of line 141 or an electromagnetic structure 147. The capabilities of electromagnetic structure 147 are compatible with those of structure 143. Upon receiving a signal from either line 141 or structure 147, the power switch and receiving transducer 145 acts to switch individual ones of the three conductors 75 into electrical contact with the associated ones of the socket connectors 127.

Figure 13:
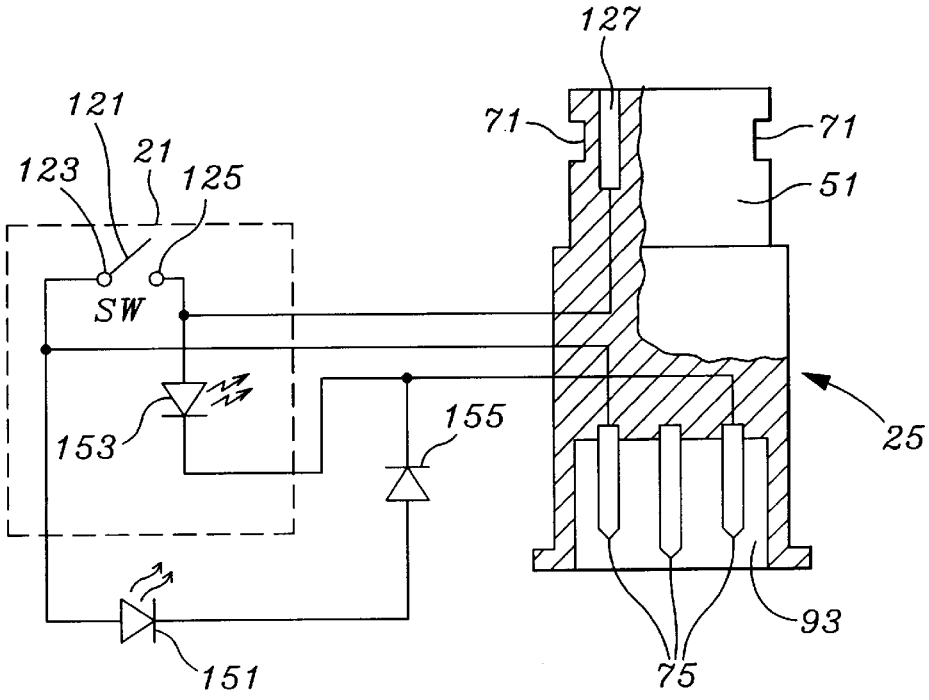
FIG. 13 is a variation on the simplified schematic of FIG. 10 and illustrating the use of lights.

Referring to FIG. 13, one possible circuit diagram for the operation of the invention is shown. When switch 121 is open, power flows through a light emitting diode 151 which may function as light 29 to indicate a power lockout condition. When the switch 121 is closed, power can flow from the left most conductor 75, through a light emitting diode 153 which may function as light 31. One or more extra diodes 155 are placed in series with light emitting diode 151 so that given an equal path of flow, the current will predominantly flow through the light emitting diode 153 when an even choice is had. Multiple diodes will add multiples of a 0.7 volt drop in order to achieve the differential flow propensity necessary.

Figure 14:
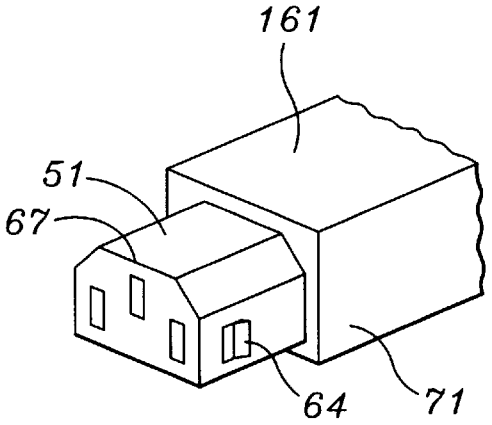
FIG. 14 is a perspective view of the front of a switching connector with clip member portion embedded in the structure, with only the flared engagement portion showing.

Referring to FIG. 14 a frontal view of a switching connector 161 is shown which has an integrally molded clip member structure which is not necessarily limited to nor similar to the clip member 59, but which has flared engagement portion 64. Since the switching connector 161 is integrally formed, the underlying structure from which the flared engagement portion 64 extends can be any structure which is moldable with the remainder of the connector as is usually done in the art.

Figure 15:
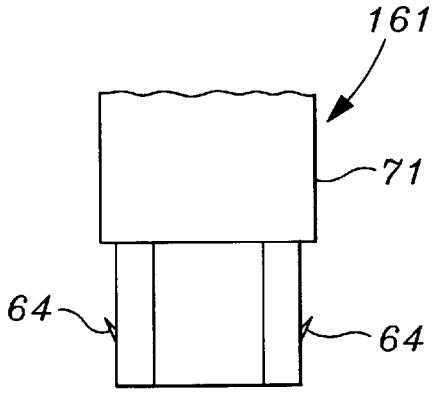
FIG. 15 is a top view of the switching connector of FIG. 14.

FIG. 15 is a top view of the switching connector 161 and further illustrates that both of the flared engagement portions 64 are the only externally viewable structures.

Figure 11:
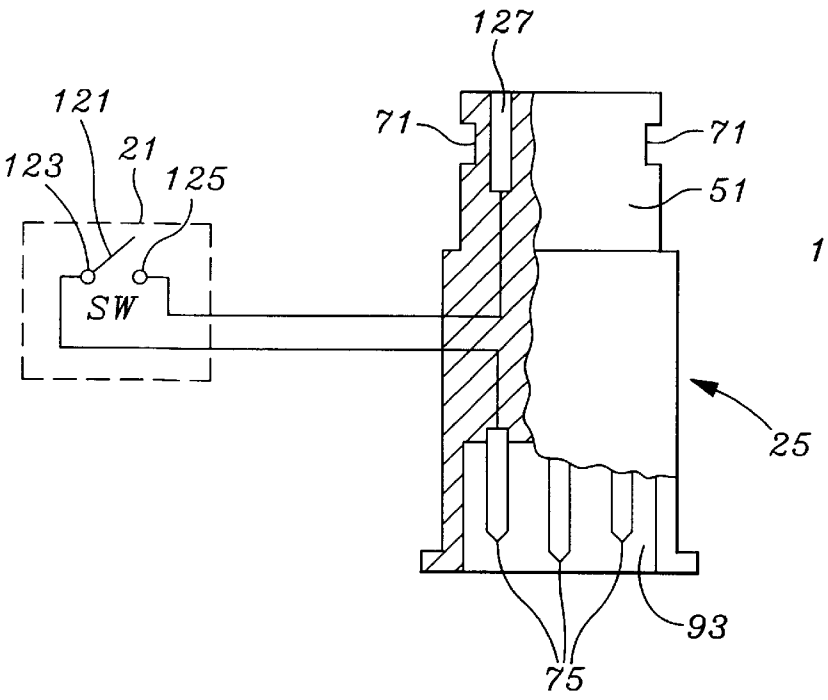
FIG. 11 is an overall simplified schematic illustrating the extension of power through a switch located in the access support structure, and which connects a single one of the conductors of the male portion of the switching connector to a single one of the conductors of the female connector portion of the switching connector.
Figure 16:
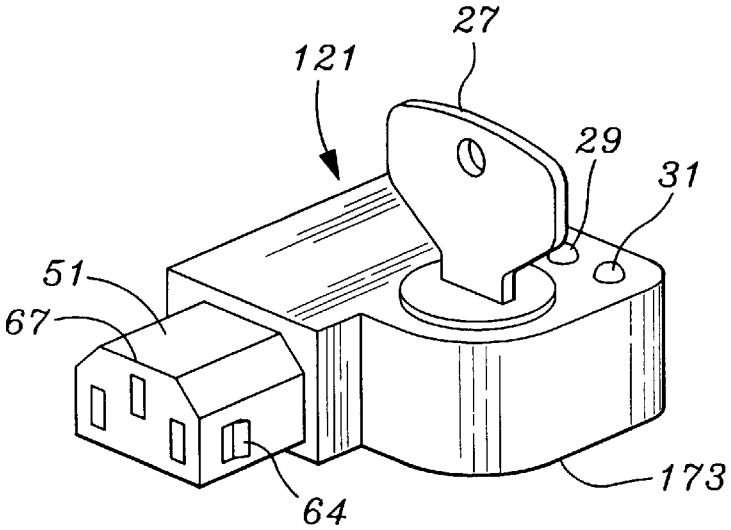
FIG. 16 is an integrated embodiment with the locking structure integral with the switching connector and thus eliminating the electromagnetically operable cable and access support structure.

FIG. 16 is an integrated switching connector 171 having an expanded housing portion 173 which accommodates key 27 and potentially the lights 29 and 31. No electromagnetically operable cable 23 is necessary. This unit is self contained, needs no additional support, and remains partially hidden. For the switching connector 25, the access support structure 21 provided a more visible communication of security. The advantage of this configuration is that one who attempts to access the computer and who is unfamiliar with the existence of the integrated switching connector 171 will spend some time trying to find out why the power is not coming on. When the integrated switching connector 171 is discovered, significant movement and manipulation of the computer housing 41 must still occur. Once an intruder begins trying to manipulate the power connections to a computer, attention will have to be drawn to himself, if done during business hours. In addition, and in contrast to the simplest circuit of FIG. 10, no extended power conductors are available for cutting to circumvent the control which is lockably supplied through the access support structure 21. Of course, where a more sophisticated circuit is supplied, such as illustrated in FIG. 11, termination of any connection link between the control of the components in the access support structure 21 and the switching connector 25 maintain the component protected by the switching connector 25 as locked.

While the present invention has been described in terms of a personal computer power locking mechanism, one skilled in the art will realize that the structure and techniques of the present invention can be applied to many appliances. The present invention may be applied in any situation where a supported electrical connector can be utilized physically as a structure to be physically and generally permanently locked onto by a lock structure and electrically in which switched control of the locked structure can be thereafter be effected.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A power locking mechanism comprising:

a male connector for interfitting with a female socket of a unit of equipment having a power inlet to be controlled and having a first contact;

mechanical locking structure interfitting with said male connector and engageable with said female socket for essentially irreversibly locking said male connector into said female socket;

a switching member, connected to said male connector, for controlling power to be supplied to said first contact of said male connector and from a second contact; and a female connector, attached to one of said switching member and said male connector for facilitating input of electrical power to be switchably controlled into said male connector, and supporting said second contact.

2. The power locking mechanism as recited in claim 1 and wherein said switching member further comprises:

a first conductor having a first end connected to said first contact and a second end;

a second conductor having a first end connected to said second contact and a second end;

a switch having a first terminal connected to said second end of said first conductor and a second terminal connected to said second end of said second conductor;

a lockout actuator connected to said switch providing limited access to operability of said switch.

3. The power locking mechanism as recited in claim 2 and wherein said lockout actuator is a key lock operable lockout actuator.

4. The power locking mechanism as recited in claim 3 and wherein said lockout actuator also includes a key pad entry lockout actuator operable in conjunction with said key lock operable lockout actuator.

5. The power locking mechanism as recited in claim 2 and wherein said lockout actuator is a key pad entry lockout actuator.

6. The power locking mechanism as recited in claim 1 and wherein said switching member further comprises:

a switch having a first terminal connected to said first contact of said a male connector and a second terminal connected to said second contact of said female connector, and an electromagnetically operable actuator port;

a lockable actuator operably compatible with an in operable communication with said electromagnetically operable actuator port for providing limited access to operability of said electromagnetically operable actuator port to thereby limit access to operation of said switch.

7. The power locking mechanism as recited in claim 6 and wherein said lockable actuator is a key lock operable lockable actuator.

8. The power locking mechanism as recited in claim 6 and wherein said lockable actuator is a key pad entry lockable actuator.

9. The power locking mechanism as recited in claim 6 and wherein said lockable actuator further comprises a housing supporting said lockable actuator and an indicator light supported by said housing and electrically connected to one of said switch, said first contact of said a male connector and said second contact of said female connector.

10. The power locking mechanism as recited in claim 1 and wherein said mechanical locking structure comprises a locking clip member interfitted externally with respect to said male connector and carrying an outwardly extending engagement structure for engaging an internal surface of said female socket of a unit of equipment having a power inlet to be controlled to prevent removal of said male connector from said female socket.

11. The power locking mechanism as recited in claim 10 and wherein said male connector includes a section having a reduced outer perimeter area and wherein said locking clip member interfits with said male connector at said reduced outer perimeter area.

12. The power locking mechanism as recited in claim 10 and wherein said male connector includes an outwardly directed accommodation spaces for facilitating fit and support of said locking clip member.

13. The power locking mechanism as recited in claim 10 and wherein said outwardly extending engagement structure has a sharp outer edge for better engaging a surface of said female socket.

14. The power locking mechanism as recited in claim 10 and wherein said locking clip member includes a pair of spaced apart side walls each supporting at least one of said outwardly extending engagement structure, each side wall each connected to a connecting web.

15. The power locking mechanism as recited in claim 10 and wherein said locking clip member further comprises:

a connecting web having a first end and a second end;

a first side wall connected to said first end of said connecting web and extending from said connecting web;

a second side wall connected to said second end of said connecting web and extending from said connecting web;

a first engagement portion extending away from said first side wall and spaced apart from said connecting web; and a first engagement portion extending away from said first side wall and spaced apart from said connecting web.

16. The power locking mechanism as recited in claim 10 and wherein said locking clip member further comprises:

a connecting web having a first end and a second end, a first edge extending between said first and second ends of said connecting web and a second edge extending between said first and second ends of said connecting web;

a first side wall having a first end connected to said first end of said connecting web and a second end away from said connecting web, a first edge extending between said first and second ends of said first side wall and a second edge extending between said first and second ends of said first side wall and continuous with said second edge of said connecting web;

a second side wall having a first end connected to said second end of said connecting web and a second end away from said connecting web, a first edge extending between said first and second ends of said second side wall and a second edge extending between said first and second ends of said second side wall and continuous with said second edge of said connecting web, said second ends of said first and second side walls flared outwardly and away from each other at their respective said second edges.

* * * * *